US008434338B2

(12) United States Patent
Armenat et al.

(10) Patent No.: US 8,434,338 B2
(45) Date of Patent: May 7, 2013

(54) DEVICE FOR COOLING A METAL STRIP

(75) Inventors: Jürgen Armenat, Kreuztal (DE); Stephan Fischer, Hilchenbach (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 753 days.

(21) Appl. No.: 12/449,138

(22) PCT Filed: Dec. 17, 2007

(86) PCT No.: PCT/EP2007/011050

§ 371 (c)(1),
(2), (4) Date: Aug. 28, 2009

(87) PCT Pub. No.: WO2008/089827

PCT Pub. Date: Jul. 31, 2008

(65) Prior Publication Data

US 2010/0024504 A1 Feb. 4, 2010

(30) Foreign Application Priority Data

Jan. 25, 2007 (DE) ..... 10 2007 003 826
Mar. 3, 2007 (DE) ..... 10 2007 010 375

(51) Int. Cl.
*B21B 27/06* (2006.01)

(52) U.S. Cl.
USPC ..... 72/201; 72/251; 72/342.2

(58) Field of Classification Search ..... 72/201, 72/342.2, 251
See application file for complete search history.

(56) References Cited

U.S. PATENT DOCUMENTS

| | | | | |
|---|---|---|---|---|
| 3,533,261 | A * | 10/1970 | Van Loon et al. | 72/201 |
| 4,400,961 | A * | 8/1983 | Schaming | 72/201 |
| 4,467,629 | A * | 8/1984 | Schimion | 72/11.7 |
| 5,799,523 | A * | 9/1998 | Seidel et al. | 72/9.3 |
| 7,523,631 | B2 * | 4/2009 | Fujibayashi et al. | 72/201 |
| 7,779,661 | B2 * | 8/2010 | Fujibayashi et al. | 72/201 |

FOREIGN PATENT DOCUMENTS

| | | |
|---|---|---|
| EP | 1 527 829 | 5/2005 |
| EP | 1 399 277 | 8/2005 |
| JP | 59 137111 | 8/1984 |
| JP | 4200816 | 7/1992 |
| JP | 2002/239623 | 8/2002 |
| JP | 2004066308 | 3/2004 |
| JP | 2006035233 A | 2/2006 |

* cited by examiner

*Primary Examiner* — Bena Miller
(74) *Attorney, Agent, or Firm* — Lucas & Mercanti, LLP; Klaus P. Stoffel

(57) ABSTRACT

The invention relates to a device (1) for cooling a metal strip (2) between two rolling stands (3), wherein the strip (2) is led over a leading-over element (4) of a flat form and arranged under the leading-over element (4) is a spraying element (5), which directs cooling medium (7) onto the underside (8) of the strip (2) through at least one opening (6) in the leading-over element (4). To achieve an improved spray pattern, the invention provides that at least two openings (6) are introduced into the leading-over element (4), said openings being arranged next to each other in a direction transverse (Q) to the conveying direction (F) of the strip (2) and having an elongated form, wherein the longitudinal axis (9) of the opening (6) is aligned at an angle (α) with respect to the conveying direction (F) of the strip.

11 Claims, 2 Drawing Sheets

DEVICE FOR COOLING A METAL STRIP

BACKGROUND OF THE INVENTION

The invention concerns a device for cooling a metal strip between two rolling stands, where the strip is guided over a guide element designed with a flat area, and where a spray element is installed below the guide element and directs cooling medium at the underside of the strip through at least one opening in the guide element.

In hot rolling mills, cooling is used between the rolling stands to control the surface temperature of the strip. Cooling between the stands achieves basically two objectives:

First, it prevents resealing of the strip by applying a small amount of water to the surface of the strip. This mode of operation is used mainly downstream of the first, more slowly running stands.

Second, the strip temperature is adjusted by cooling between the stands as part of the technological process management for adjusting certain material properties by applying the amount of water to the strip that is necessary for this purpose.

In this connection, it is important that the water be applied to the largest possible surface area of the strip. The amounts of water that are typically necessary for cooling between the stands varies from about 80 to 280 $m^3/h$ with application of water to both sides of the strip. The water pressure in this operation is 1-10 bars.

To achieve an enhanced cooling effect of the rolling stand with the same length of a cooling zone between two stands, EP 0 998 993 B1 provides a combination of cooling between the stands and an additional roll cooling in the area of the runout side of the roll gap with the use of a directed stream of pressurized water along a circumferential region of the roll barrel of each work roll. In this process, the cooling between rolls and the roll cooling are each carried out with contactless sealing means for the surface of the rolling stock and the surface of the roll barrel.

DE 37 04 599 A1 describes a method for cooling hot rolling stock moving on a horizontal conveyor, where liquid coolant in the form of laminar water curtains is applied to the rolling stock from above and below. To keep the consumption of cooling water low, the cited patent provides that the water curtains can be adjusted in their width and thickness continuously and independently of each other.

EP 1 399 277 B1 discloses a method for cooling and lubricating the rolls of a rolling stand, in which, for the purpose of economical roll cooling and lubrication, either only lubricant is applied, or only the rolling stock cooling system is activated, depending on boundary conditions and requirements.

EP 1 624 078 A1 discloses a device for cooling a strip of sheet metal with nozzles for a cooling liquid to be sprayed onto the underside of the strip arranged below the strip in rows transverse to the direction of strip conveyance. To create favorable cooling conditions, the cited patent provides that the nozzles, which are designed as fan nozzles, form a common central spraying surface for each transversal row. The invention also provides that covers, which are positioned alongside the strip of sheet metal, are provided in the spraying region of the nozzles.

WO 2005/115651 A1 discloses a method and a device for cooling and/or lubricating rolls and/or rolling stock with the use of cooling medium and base oil. To realize improved lubrication in the roll gap, the cooling medium is applied to the rolls separately from the base oil, and exclusively the base oil, without water as a carrier medium, is applied directly to the rolling stock over its entire width in an amount that is very small relative to the usual amount.

EP 1 527 829 A1 and JP 2002-239623 A describe solutions in which cooling devices have a guide element in which a pattern of holes is incorporated to ensure the admission of cooling liquid to the strip to be cooled.

In cooling systems between rolling stands, a specific problem that arises is that both at minimum pressure and at maximum pressure, it is necessary to achieve a spray pattern of the cooling liquid on the strip to be cooled that ensures overlapping that is sufficient to avoid roping on the surface of the strip.

In this regard, special attention must be paid to the spray pattern produced at the lower nozzle spray bar, i.e., during the spraying of the strip with a nozzle spray bar on the underside of the strip. The lower nozzle spray bar is located below a guide table, on which the strip to be cooled is running. The guide table has especially the job of guiding the strip horizontally between an outlet guide and a looper.

The spray water of the lower nozzle spray bar must be conveyed through the guide table. This means that the guide table must be provided with openings for the cooling medium. In this regard, it has been found that the formation of unspecifically shaped openings does not lead to a satisfactory result. Optimal spray patterns cannot be realized without specific shaping of the openings. In addition, in the case of unspecifically shaped openings, unacceptable mechanical weakening of the guide table can occur.

SUMMARY OF THE INVENTION

Therefore, the objective of the invention is to further develop a system of the aforementioned type for cooling between rolling stands in such a way that better cooling becomes possible by the creation of an improved spray pattern on the strip, especially on its underside, such that it is intended that more homogeneous cooling over the width and length of the strip should be achieved.

In accordance with the invention, this objective is achieved by placing at least two openings in the guide element, which are arranged side by side in the direction transverse to the direction of conveyance of the strip and have an oblong shape as seen in a top view of the guide element, such that the longitudinal axis of the opening is oriented at an angle to the direction of conveyance of the strip, and such that the two or more openings, which lie side by side parallel to one another in the direction transverse to the direction of conveyance, extend over the same area of extension in the direction of conveyance.

This angle is preferably 10-50°, and more preferably 20-40°.

Generally, a plurality of adjacent openings is formed in the guide table.

The openings in the guide table preferably have a length that is at least twice the width of the openings and preferably at least three times the width.

Several spray nozzles can be mounted in the spray element along the longitudinal axis of the openings.

Overlapping of the transverse extent of the openings is preferably present in the direction transverse to the direction of conveyance of the strip. This results in an optimum spray pattern during the spraying of the cooling medium. The transverse extent of the openings is realized in such a way that the front end of an opening with respect to the direction of conveyance of the strip projects beyond the rear end of the adjacent opening towards the side of the adjacent opening as viewed in the direction transverse to the direction of conveyance of the strip.

The guide element is preferably a guide table that is already well known as such, and it is advantageous for the spray element to be designed as a spray bar.

The design of a device for cooling a metal strip in accordance with the invention has the advantage that the cooling device designed for cooling between rolling stands makes it possible to apply cooling medium over a greater application length of the strip. It also ensures sufficient overlapping in the direction transverse to the conveyance or rolling direction of the strip, which is true both at low pressure and at high pressure.

The drawings illustrate a specific embodiment of the invention.

Figure 1:
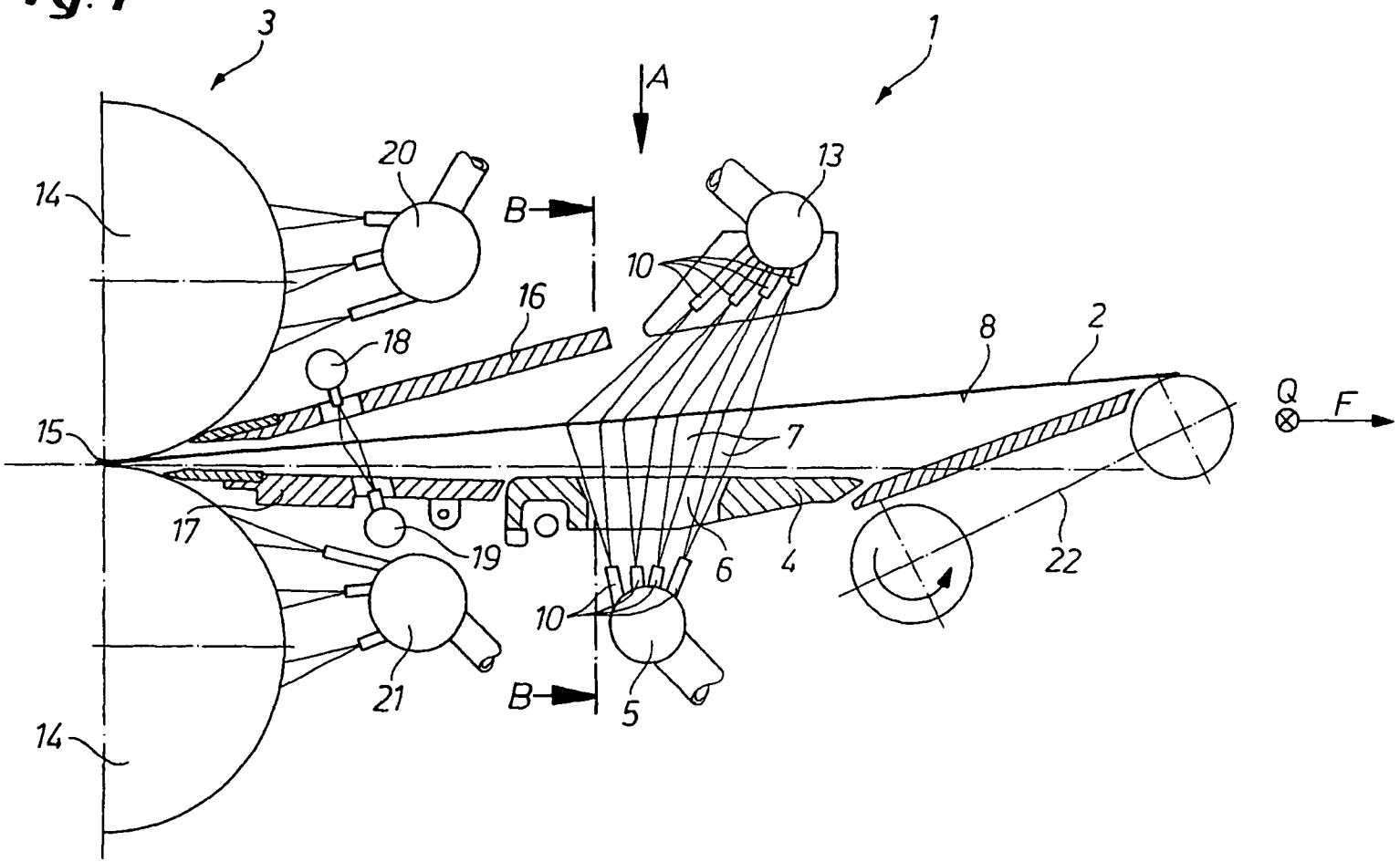
FIG. 1 is a side view of a device installed between two rolling stands for cooling a metal strip.

DETAILED DESCRIPTION OF THE DRAWINGS:

FIG. 1 shows a device 1 for cooling a metal strip 2, which is designed as a cooling system between rolling stands. It is arranged between two rolling stands, but only one rolling stand 3 is shown in FIG. 1.

The strip 2 is conveyed over a guide table 4 (guide element) in the rolling direction or direction of conveyance F, as is already well known in itself. An upper spray bar 13 and a lower spray bar 5 for cooling the hot-rolled strip 2 are positioned above and below the guide table 4. The upper spray bar 13 sprays the upper side of the strip, and the lower spray bar 5 sprays the underside 8 of the strip 2. The spray bars 5 and 13 each have a plurality of spray nozzles 10 that apply the cooling medium (water) 7.

Various other components are provided, which in themselves are already well known:

The rolls 14 form a roll gap 15, through which the strip 2 passes. Roll strippers or outlet guides 16, 17 are mounted downstream of the rolls 14. Spray water from upper and lower spray bars 18, 19 is sprayed onto the surface of the strip through openings in these guides 16, 17.

Work roll cooling systems 20, 21 are provided for cooling the rolls 14.

A looper 22 is positioned after the guide table 5.

The spray water of the lower spray bar 5 is sprayed onto the strip 2 through openings 6 in the guide table 4. In this regard, it is important that at least two openings 6 are formed in the guide table 4. These openings 6 are arranged side by side in the direction Q transverse to the direction of conveyance F of the strip 2 and have an oblong shape as seen in a top view of the guide table 4. The longitudinal axis 9 of the opening 6 is oriented at an angle $\alpha$ to the direction of conveyance F of the strip. In the embodiment of the invention illustrated here, the angle $\alpha$ is about 30°.

Figure 2:
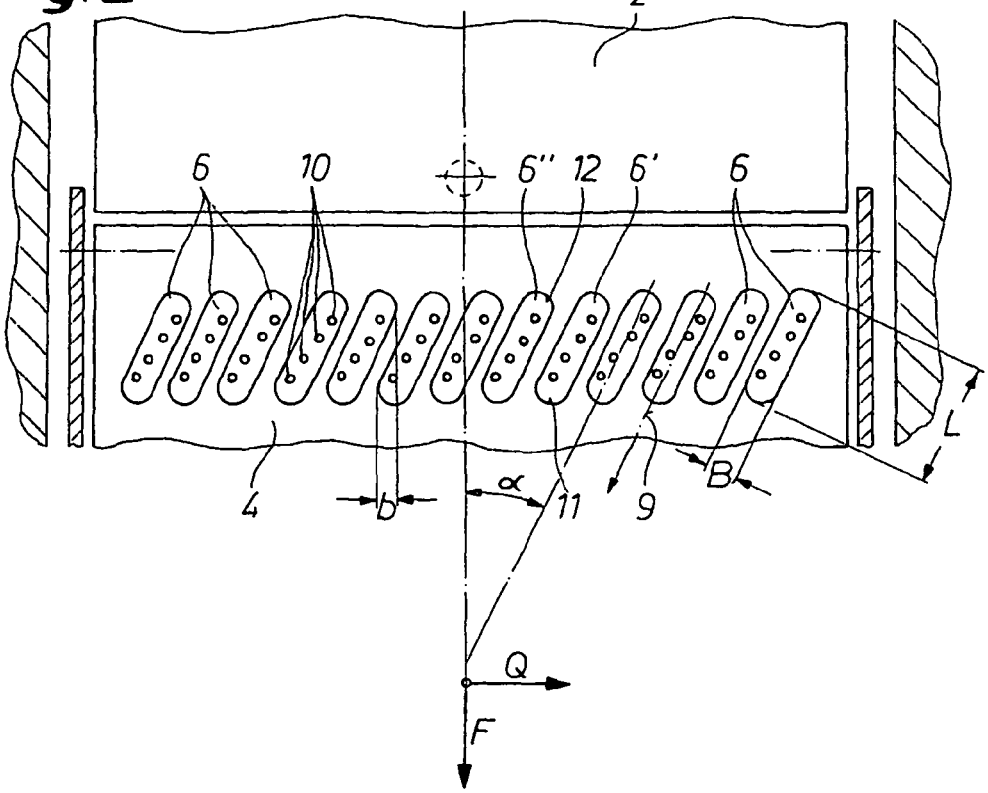
FIG. 2 is view "A" indicated in FIG. 1, i.e., a top view of the guide table of the device without showing the spray bar positioned above the strip.

This embodiment is illustrated in greater detail in FIG. 2, which shows that there are several oblong openings 6 arranged side by side. The longitudinal axis 9 of the openings 6 runs parallel to the plane of the surface of the guide table 4 and to the plane of the strip 2.

The length L of the openings 6 is much greater than the width B. The length L should be at least twice the width B and preferably at least three times the width. The drawing also reveals that the individual openings 6 overlap in the direction Q transverse to the direction of conveyance F. The overlap b is drawn for two adjacent openings 6. This can also be seen from the two openings 6' and 6", which are located next to each other and have a front end 11 and a rear end 12. If the end of the opening in direction Q is projected on the front end 11 of the opening 6', it is found that it already lies behind the transverse extent of the adjacent opening 6" in the rear end region 12 of this opening. This means that complete transverse overlapping of the spraying of the strip 2 with cooling medium is achieved.

In addition, FIG. 2 shows that several spray nozzles 10 are arranged one after the other along the longitudinal axis 9 of the openings 6, so that a continuous flow of cooling medium along the longitudinal extent of the openings is ensured.

Figure 3:
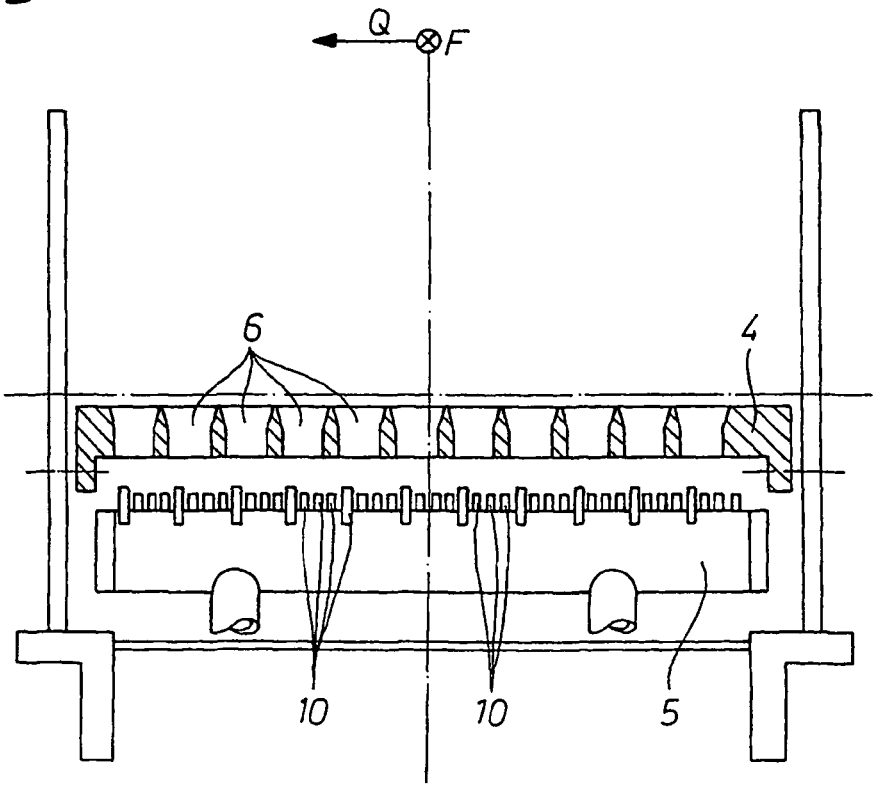
FIG. 3 shows the section B-B according to FIG. 1.

FIG. 3 shows that the lower spray bar 5 (the same applies analogously to the upper spray bar 13) has a plurality of spray nozzles 10, which spray the strip 2 with cooling medium.

The arrangement and orientation of the openings, i.e., the slots for the passage of cooling water, ensures sufficient stability of the guide table, i.e., they cause no significant mechanical weakening of the guide table 4. In conjunction with a suitable arrangement of the nozzles 10 on the spray bar 5, an optimum spray pattern can thus be realized under all typical operating conditions.

LIST OF REFERENCE NUMBERS

1 cooling device
2 metal strip
3 rolling stand
4 guide element (guide table)
5 spray element (spray bar)
6 opening
6' opening
6" opening
7 cooling medium
8 underside
9 longitudinal axis
10 spray nozzle
11 front end of the opening
12 rear end of the opening
13 spray bar
14 roll
15 roll gap
16 outlet guide
17 outlet guide
18 spray bar
19 spray bar
20 work roll cooling system
21 work roll cooling system
22 looper
F direction of conveyance of the strip
Q direction horizontal and transverse to the direction of conveyance of the strip
$\alpha$ angle
L length of the opening
B width of the opening
b overlap

The invention claimed is:

1. A device (1) for cooling a metal strip (2) between two rolling stands (3), the device comprising: a guide element (4) having a flat area, the strip being guidable over the guide element; and a spray element (5) installed below the guide element (4) so as to direct cooling medium (7) at an underside (8) of the strip (2) through at least two openings (6) formed in the guide element (4), which the openings are arranged side by side in a direction (Q) transverse to a direction of conveyance (F) of the strip (2) and have an oblong shape, such that a longitudinal axis (9) of each opening (6) is oriented at an angle ($\alpha$) to the direction of conveyance (F) of the strip, and such that the at least two openings (6), are side by side parallel to one another in the direction (Q) transverse to the direction of conveyance (F) and each extend over an equal area of extension in the direction of conveyance (F).

2. A device in accordance with claim 1, wherein the angle ($\alpha$) is 10-50°.

3. A device in accordance with claim 2, wherein the angle ($\alpha$) is 20-40°.

4. A device in accordance with claim 1, wherein a plurality of adjacent openings (6) is formed in the guide element (4).

5. A device in accordance with claim 1, wherein the openings (6) in the guide element (4) have a length (L) that is at least twice the width (B) of the openings (6).

6. A device in accordance with claim 1, wherein several spray nozzles (10) are mounted in the spray element (5) along the longitudinal axis (9) of the openings (6).

7. A device in accordance with claim 1, wherein overlapping (b) of the transverse extent of the openings (6) is present in the direction (Q) transverse to the direction of conveyance (F) of the strip (2).

8. A device in accordance with claim 7, wherein the openings (6) have a transverse extent so that the front end (11) of an opening (6') with respect to the direction of conveyance (F) projects beyond the rear end (12) of the adjacent opening (6") towards the side of the adjacent opening (6") as viewed in the direction (Q) transverse to the direction of conveyance (F) of the strip (2).

9. A device in accordance with claim 1, wherein the guide element (4) is a guide table.

10. A device in accordance with claim 1, wherein the spray element (5) is a spray bar.

11. A device in accordance with claim 5, wherein the length of the openings in the guide element is at least three times the width (B).

* * * * *

UNITED STATES PATENT AND TRADEMARK OFFICE

CERTIFICATE OF CORRECTION

PATENT NO. : 8,434,338 B2
APPLICATION NO. : 12/449138
DATED : May 7, 2013
INVENTOR(S) : Armenat et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 784 days.

Signed and Sealed this
Eighth Day of September, 2015

Michelle K. Lee

Michelle K. Lee
*Director of the United States Patent and Trademark Office*